US005343784A

United States Patent [19]

Neuhaus

[11] Patent Number: 5,343,784

[45] Date of Patent: Sep. 6, 1994

[54] ROTARY TOOL

[75] Inventor: Klaus Neuhaus, Wuppertal, Fed. Rep. of Germany

[73] Assignee: Eduard Wille GmbH Co., Fed. Rep. of Germany

[21] Appl. No.: 110,091

[22] Filed: Aug. 20, 1993

[30] Foreign Application Priority Data

Sep. 1, 1992 [DE] Fed. Rep. of Germany ... 9211729[U]

[51] Int. Cl.[5] ..... B25B 13/00

[52] U.S. Cl. ..... 81/55; 81/177.85

[58] Field of Search ..... 81/13, 55, 56, 125, 81/487, 58, 436, 437, 438, 451, 124.3, 124.6, 177.85, 462

[56] References Cited

U.S. PATENT DOCUMENTS

| | | | |
|---|---|---|---|
| 3,394,623 | 7/1968 | Kinakin | 81/55 |
| 3,889,558 | 6/1975 | Duncan | 81/55 |
| 4,165,660 | 8/1979 | Behrens | 81/55 |
| 4,733,584 | 3/1988 | Karga | 81/177.85 |

FOREIGN PATENT DOCUMENTS

| | | |
|---|---|---|
| 0066710 | 5/1982 | European Pat. Off. . |
| 2906719 | 2/1979 | Fed. Rep. of Germany . |

OTHER PUBLICATIONS

Advertisement which appeared in "Aviation Week", on Nov. 22, 1965.

*Primary Examiner*—D. S. Meislin

*Attorney, Agent, or Firm*—Mallinckrodt & Mallinckrodt

[57] ABSTRACT

The rotary tool has an element (10) rotatable about an axis of rotation and provided with a polygonal pin (16). A wrench socket insert (3), having a recess complementary to the polygonal pin (16), can be placed at the polygonal pin (16). The polygonal pin (16) and the tool (3) have longitudinal throughbores (18, 30). A tool element as a retaining control member (2) can be passed through the longitudinal throughbores. A transverse bore (20) is provided in the polygonal pin (16) and connected, on the one hand, to the longitudinal throughbore (18) and ends, on the other hand, at the outer surface of the polygonal pin (16). A detent ball (22) is located in the transverse bore (20) and adapted to snap into a detent passage (28) in the tool element (3). The retaining control member, as a further rotary tool element (2), can be pulled out from and rotated in the longitudinal throughbore (18); it has a cylindrical peripheral surface engaged by the detent ball (22) and thus keeps the detent ball (22) engaged with the tool element (3). At its inner end, the transverse bore (20) has a constriction (24) engaged by the detent ball (22) in its innermost position to prevent the same from falling out of the transverse bore (20) into the longitudinal throughbore (18) when the further rotary tool (2) is pulled out. In this innermost position, the detent ball (22) is forced completely out of the detent passage (28) into the transverse bore (20).

5 Claims, 4 Drawing Sheets

ROTARY TOOL

BACKGROUND OF THE INVENTION

1. Field

The present invention is in the field of rotary tools, such as socket wrenches and power and impact tools, utilizing quick release and positive locking mechanism.

2. State of the Art

A rotary tool of the type concerned is described in European Patent Application No. 0,066,710, published on Dec. 15, 1982. Therein, a longitudinally displaceable, retaining control member is provided and has a lateral, longitudinally widening recess. The retaining control member extends through the longitudinal throughbore of a pivot portion of a ratchet, which has a square pin, i.e. drive stud, provided thereat. The recess cooperates with a detent ball, which is movable in a transverse bore of the square pin. The retaining control member is loaded with the force of a spring and keeps the square pin in a locking position in which the detent ball is in locking engagement with a detent recess of the square pin of the ratchet as a wrench socket insert. The wrench socket insert is thereby safely held by the square pin or the ratchet.

The retaining control member is rotatable about its axis in the longitudinal throughbore, which extends through the pivot portion and the square pin between a releasing position and a locking position. It is thus ensured that the locking position cannot be released unintentionally by acting on the spring loading the retaining control member. In the releasing position, the retaining control member can be displaced only against the force of the spring longitudinally of the throughbore such that the ball can be released from the locking engagement and the wrench socket insert can be released. In the direction toward the outer surface of the square pin, the transverse bore has a constriction which prevents the ball from falling out from the transverse bore when the wrench socket insert is removed.

A ratchet of similar type is described in German Published Patent Application No. 2,906,719.

Countersunk bolts are known as connecting members. They comprise a threaded portion for fastening purposes by means of a nut as in the HI-LOK Fastener produced by Hi-Shear Corporation, 2600 West 247th Street, Torrance, Calif. As published in Aviation Week, Nov. 22, 1965, a profiled cut-out extends from the free end of a threaded portion for engagement with a screwdriver having a correspondingly profiled engagement portion. By means of the thus-inserted screwdriver, the countersunk bolt can be held stationary while the nut is being tightened by means of a ratchet and a wrench socket insert. The screwdriver extends through a longitudinal throughbore of the ratchet and the wrench socket insert.

SUMMARY OF THE INVENTION

It is an object of the invention to provide a rotary tool of this type by combining two coaxial rotary tools, one of which comprises an insertable tool element.

In the accomplishment of this and of further objects that will become apparent as the description proceeds, features of the invention are:

(a) the provision of a retaining control member that constitutes a rotary tool element adapted to be pulled out from the longitudinal throughbore and that is rotatable therein, such tool defining a cylindrical peripheral surface which is engaged by the detent ball in order to keep the detent ball in engagement with the tool element;

(b) the transverse bore defines an inner end provided with a constriction engaged by the detent ball in an innermost position thereof and preventing the detent ball from falling out from the transverse bore into the longitudinal throughbore when the rotary tool element, i.e. retaining member, is pulled out from the longitudinal throughbore; and (c) the detent ball, when assuming the innermost position, is completely forced out from the detent passage into the transverse bore.

In this manner, the rotary tool element functions to keep the detent ball in engagement with the detent passage. Thus, the rotary tool element and tool can be released together from a workpiece, with the provision that the tool element cannot become released and fall down. The rotary tool is freely rotatable relative to the tool element, and when the tool element is pulled out, the rotary tool becomes free. However, the detent ball cannot fall inward into the longitudinal throughbore.

Thus, the present invention provides a rotary tool having an element which is rotatable about an axis and which is provided with a polygonal pin. A tool element, having a recess complementary to the polygonal pin, can be placed onto the polygonal pin. The polygonal pin and the tool element have longitudinal throughbores extending along their axes of rotation so that a retaining member can be passed therethrough. A transverse bore is provided in the polygonal pin and opens into the longitudinal throughbore at one of its ends, while its other end terminates at the outer surface of the polygonal pin. A detent ball is located in the transverse bore and can be lockingly received in a detent passage in the tool element.

THE DRAWINGS

The invention will be better understood and objects other than those set forth above, will become apparent when consideration is given to the following detailed description thereof. Such description makes reference to the annexed drawings wherein the same or analogous components are designated by the same reference characters and wherein.

DETAILED DESCRIPTION OF THE PREFERRED EMBODIMENTS

Figure 1:
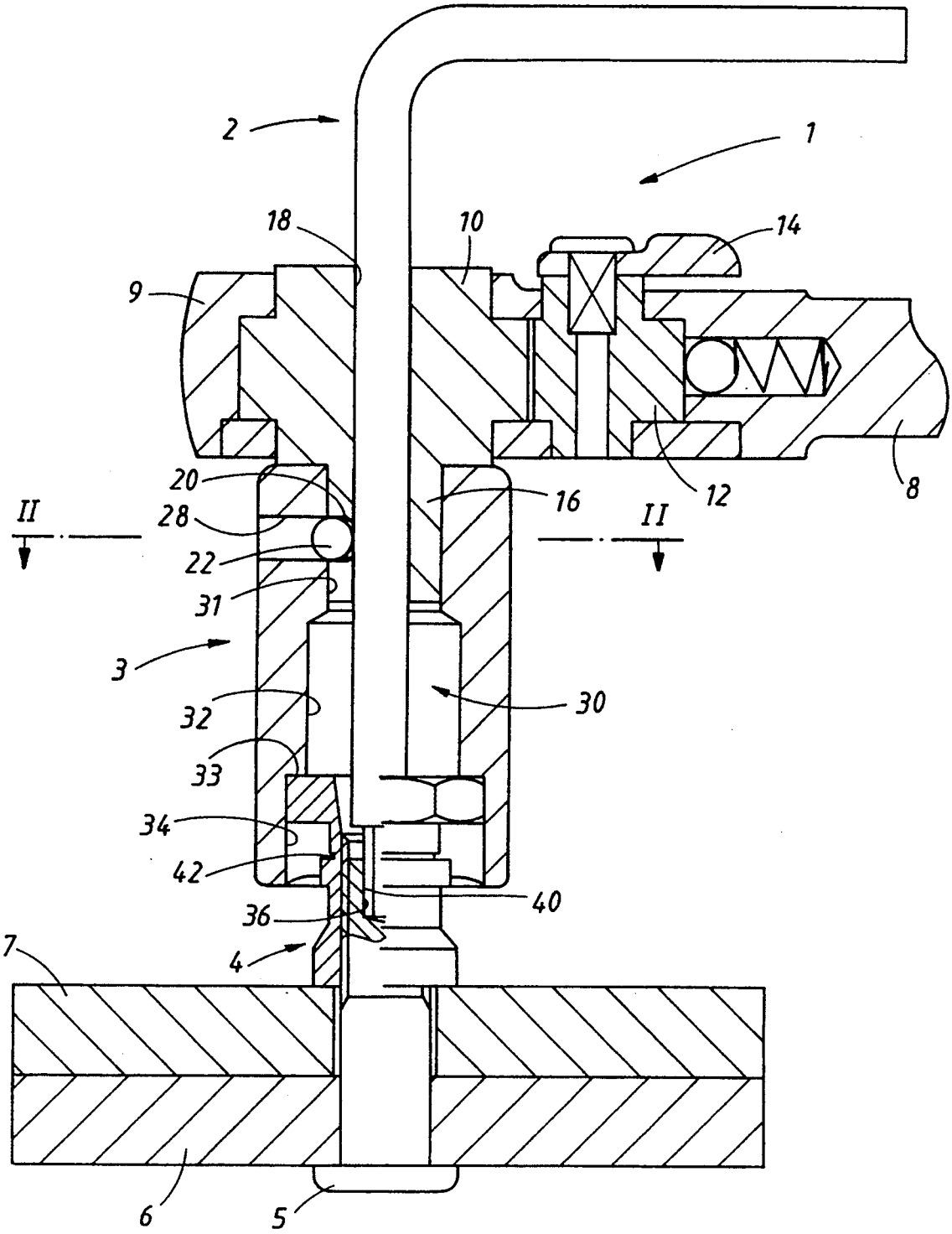
FIG. 1 is a vertical section taken axially through a ratchet tool according to the invention, including a wrench socket insert and an angled screwdriver.

Describing now the drawings, it is to be understood, that only enough of the construction of the rotary tool has been shown as needed for those skilled in the art to readily understand the underlying principles and concepts of the present development, while simplifying the showing of the drawings. Turning attention now specifically to FIG. 1 of the drawings, there is shown therein a ratchet 1 with a screwdriver 2, as an insertable tool element, and a wrench socket insert 3 in engagement with a fastening means 4. This fastening means contains a shear nut on the threaded portion of the countersunk bolt 5 and serves to fasten two bodies 6 and 7 to each other.

In the illustrated embodiment, the tool element 2 is shown in the form of an angled screwdriver; however, the ratchet 1 can, of course, be provided with any other type of screwdriver having at one end a profiled engagement portion designed for engagement with a correspondingly profiled recess at a screw or the like.

In detail, the ratchet 1 comprises a handle 8 which is only partially illustrated, and a head portion 9 at one end of the handle 8. An element constituting a pivot portion 10 is inserted into the head portion 9 supported for rotation about a central axis of rotation extending from the bottom to the top in the plane of the drawing. The axis of rotation can be adjusted at the ratchet 1 by means of an adjusting device which is generally designated by the reference numeral 12 and comprises a switch 14. Such adjusting devices in ratchets are known and are thus not described in detail herein.

The pivot portion 10 is provided with a square pin 16 which projects therefrom on the side that is remote from the switch 14. A longitudinal throughbore 18 passes through the pivot portion 10 and the square pin 16 and constitutes, in the illustrated embodiment, an axial cylindrical throughbore and thus extends along the axis of rotation of such pin portion 10. The screwdriver 2 extends through the longitudinal throughbore 18 and has, in this area, an outer diameter which is adapted to the inner diameter of the longitudinal throughbore 18. The outer diameter of the screwdriver 2 and the inner diameter of the longitudinal throughbore 18 are adapted to each other such that the screwdriver 2 and the pivot portion 10 including the square pin 16 are freely rotatable relative to each other within the longitudinal throughbore 18. The screwdriver is thus freely displaceable in the longitudinal direction of the longitudinal throughbore 18 and can be pulled out therefrom.

The square pin 16 further contains a transverse bore 20 in which a detent ball 22 is freely movably received. This arrangement is shown in detail in FIGS. 2 and 3.

Figure 2:
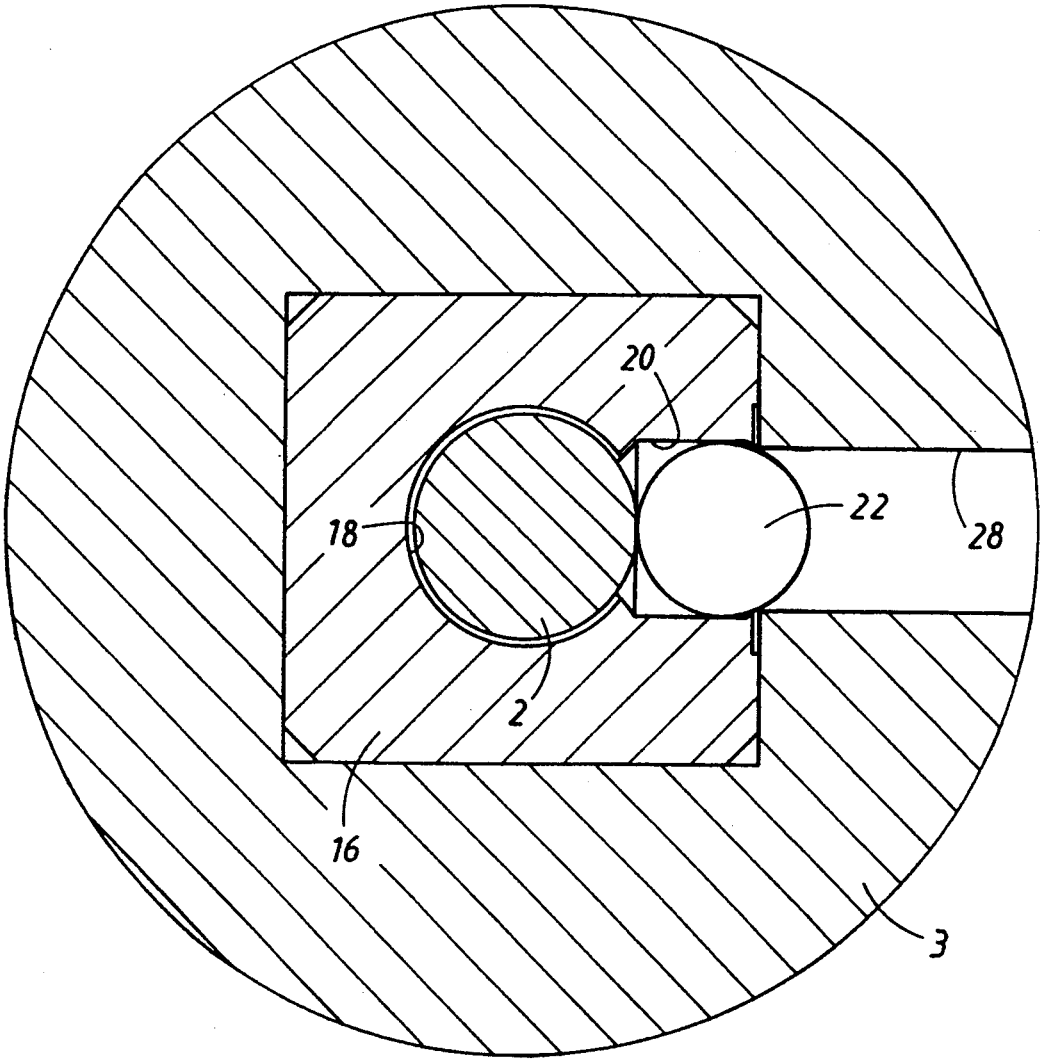
FIG. 2 is a horizontal section taken along the line II—II.

FIG. 2 shows a section through the arrangement of FIG. 1 taken along a line II—II. The screwdriver 2 in the longitudinal throughbore 18 of the square pin 16 will be recognized therein at the center; the square pin 16 is surrounded by the wrench socket insert 3 placed thereat. The detent ball 22 protrudes from a detent passage 28 formed in the wrench socket insert 3. In the illustrated embodiment, the detent passage is formed as a radial bore which is aligned with the transverse bore 20 in the square pin 16.

Figure 3:
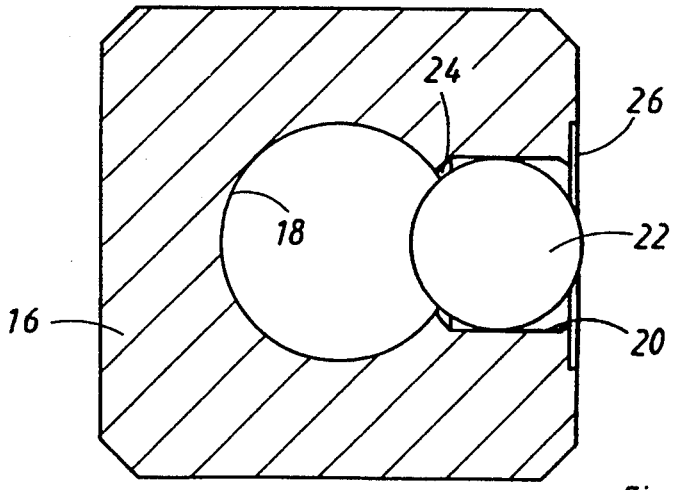
FIG. 3 is a view similar to that of FIG. 2, but with the wrench socket insert removed.

The arrangement of the detent ball 22 in the transverse bore 20 of the square pin 16 is illustrated in FIG. 3. Safety means are provided to ensure that the spherical inner detent ball 22 cannot fall out from the transverse bore 20 in the absence of the screwdriver 2 and/or the wrench socket insert 3. In the illustrated embodiment, these safety means comprise a conically tapered constriction 24, FIG. 3, merging into the annular surface of the transverse bore 20 at the end opening into the axial longitudinal throughbore 18 of the square pin 16, and a calk plate 26 formed at the end opening at the outer surface of the square pin 16. Thus, on the one hand, the detent ball 22 is prevented from passing into the longitudinal throughbore 18 from the transverse bore 20 in the release position which the detent ball 22 assumes after corresponding longitudinal displacement or removal of the screwdriver 2 from the longitudinal throughbore 18. On the other hand, it is thus made impossible for the detent ball 22 to fall out from the transverse bore 20 of the square pin 16 in the absence of the wrench socket insert 3. However, these safety means are also designed such that, when the screwdriver 2 is inserted into the throughbore 18, the detent ball 22 is displaced outwardly to such extent as to engage the radial bore 28 or the detent recess in the wrench socket insert 3. The wrench socket insert is thus held safely at the square pin 16 without impairment of the free longitudinal movability and rotatability of the screwdriver 2.

The wrench socket insert 3 placed at the square pin 16 is constructed in conventional manner and contains a stepped passage 30. The first step 31 of this passage 30 is provided with an internal profile which is adapted to the external profile of the square pin 16. The second, wider step 32 leads via annular shoulder 33 to a third, still wider step 34 of the passage 30. The third step 34 is provided with a polygonal internal profile for engagement with the external profile of a nut.

The first step 31 of the passage 30 contains the radial bore 28 which extends transversely of the passage 30. In the placed-on state of the wrench socket insert 3, the radial bore 28 is aligned with the transverse bore 20 of the square pin 16.

In the illustrated embodiment, the third step 34 of the passage 30 is shown in engagement with the external profile of the shear nut 4 which is threaded onto the threaded portion of the countersunk bolt 5. The threaded portion of the countersunk bolt 5 contains a profiled cut-out 36. A correspondingly profiled engagement portion 40 of the screwdriver 2 extends into this cut-out 36.

Figure 4:
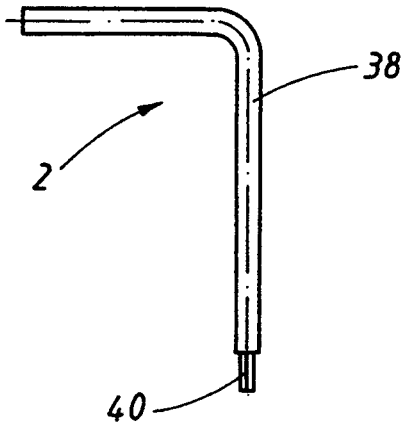
FIG. 4 is a view in elevation of the angled screwdriver per se.

The screwdriver 2 is illustrated in detail in FIG. 4 and comprises a cylindrical shaft portion 38 having an outer diameter which is adapted to the inner diameter of the longitudinal throughbore 18. At the engagement end, the screwdriver 2 comprises the profiled engagement portion 40 having a hexagonal profile which is adapted to the profiled cut-out 36 in the threaded portion of the countersunk bolt 5.

The aforedescribed ratchet operates as follows:

At first, the wrench socket insert 3 is connected to the square pin 16 and the screwdriver 2 is inserted into the longitudinal throughbore 18. The spherical inner detent ball 22 is thereby forced outwardly in the transverse bore 20 of the square pin 16 to such extent that it extends into the radial bore 28 of the wrench socket insert 3. As a consequence, the wrench socket insert 3 is safely held on the square pin 16 or the ratchet 1, respectively. Then, the profiled engagement portion 40 of the screwdriver 2 which protrudes from the wrench socket insert 3, is inserted into the profiled cut-out 36 formed in the threaded portion of the countersunk bolt 5. In conjunction therewith, the third step of the passage 30 in the wrench socket insert 3 is placed into engagement with the shear nut 4. Upon actuating the ratchet 1, i.e. upon rotating the pivot portion 10 including the square pin 16 relative to the screwdriver 2 in the preset direction of rotation, the countersunk bolt 5 is manually held stationary thereagainst by means of the screwdriver 2 and the shear nut 4 is tightened by means of the wrench socket insert 3 which is rigidly connected to the ratchet 1. The bodies 6 and 7 are thereby tightened against each other and secured to each other. Upon continued actuation of the ratchet 1, the shear nut 4 is finally sheared at the weak point 42 which will be recognized in FIG. 1.

After tightening or shearing of the nut 4, the ratchet 1 along with the screwdriver 2 and the wrench socket insert 3 is directly available for further use of the same type. For eventually required replacement of the wrench socket insert 3, the screwdriver 2 can be readily removed from the longitudinal throughbore 18 or sufficiently displaced therein in the longitudinal direction such that the wrench socket insert 3 becomes free and can be replaced. During such operation, the safety means in the form of the constriction 24 and the calk plate 26 ensure that the spherical inner body 22 cannot fall out from the transverse bore 20 of the square pin 16.

Figure 5:
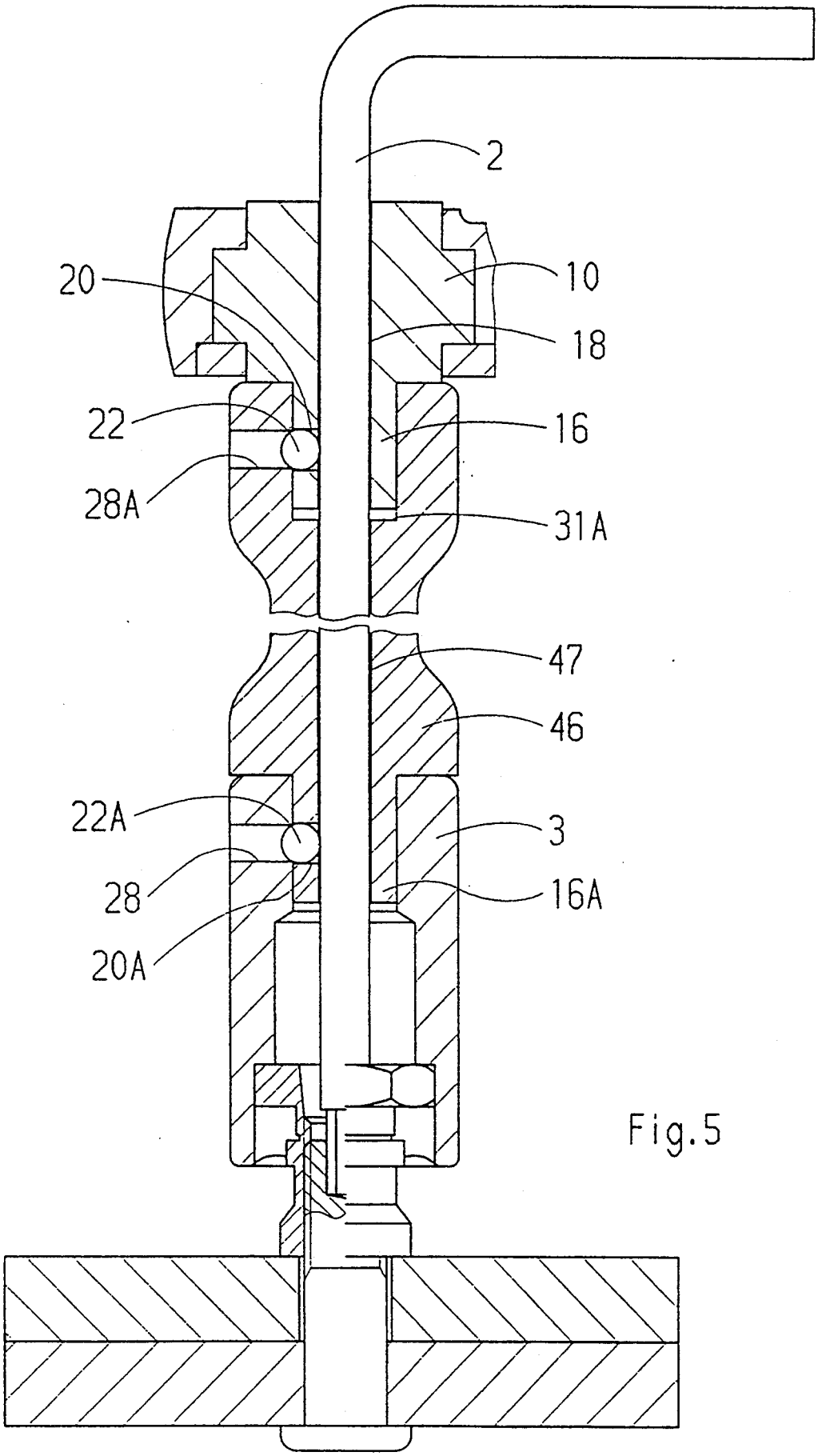
FIG. 5 is a view corresponding to that of FIG. 1 but including an intermediate extension element having a portion of its length broken out for convenience of illustration.

The arrangement shown in FIG. 5 is constructed similarly to the arrangement illustrated in FIG. 1. In such arrangement, an extension element 46 is inserted between the pivot portion 10 including the square pin 16 and the wrench socket insert. The extension element 46 has a longitudinal throughbore 47 aligned with the longitudinal throughbore 18 which extends through the pivot portion 10 and the square pin 16. Furthermore the extension element 46 also has a square pin 16A, which corresponds to the square 16, at its end facing the wrench socket insert 3.

A square recess 31A is formed in the extension element 46 at the end facing the pivot portion 10 and the square recess 31A receives the square 16.

Furthermore, a transverse or radial bore 28A corresponding to the transverse or radial bore 28 in the wrench socket insert 3, is provided in the extension element 46 at the end facing the pivot portion 10. This transverse or radial bore 28A ends in the square recess 31A. The transverse or radial bore 28A is aligned with the transverse or radial bore 20 formed in the square pin 16. It forms a detent recess for the detent ball 22 of the square pin 16.

A transverse or radial radial bore 20A including a detent ball 22A is provided in the square pin 16A of the extension element 46 at the end facing the wrench socket insert 3. The transverse or radial bore 20A is aligned with the transverse or radial bore 28 formed in the wrench socket insert 3.

The two detent balls 22 and 22A are forced radially outwardly in the bores 28A and 28, respectively, by the cylindrical outer surface at the shaft of the screwdriver 2. Thus, the extension element 46 is locked at the pivot portion 10 and the wrench socket insert 3 is locked at the extension element 46. In both cases, locking is effected due to the presence of the screwdriver 2. When the screwdriver 2 is pulled out, then, the constrictions in the bores 20 and 20A will ensure that the balls cannot pass from the respective transverse bores 20 and 20A into the longitudinal throughbores 18 and 42, respectively.

While there are shown and described present preferred embodiments of the invention, it is to be distinctly understood that the invention is not limited thereto, but may otherwise be variously embodied and practiced within the scope of the following claims.

I claim:

1. A rotary tool having an element (10) rotatable about an axis of rotation and provided with a polygonal pin (16); a wrench socket insert (3) having a recess complementary to the polygonal pin (16) and adapted to be placed onto the polygonal pin (16); the polygonal pin (16) and the tool (3) having longitudinal throughbores (18, 30) extending along the axis of rotation; a retaining control member (2) for passing through the longitudinal throughbores (18, 30); a transverse bore (20) provided in the polygonal pin (16) and opening, at one of its ends, into the longitudinal throughbore (18) and, at an other end, at the outer surface of the polygonal pin (16); a detent ball (22) located in the transverse bore (20); and a detent passage (28) in the rotary tool (3) for lockingly receiving therein the detent ball (22), (a) the element (10) is a pivot portion inserted into a head portion (9) in which a ratchet (1) is mounted for rotation about the axis of rotation, the ratchet (1) including said pivot portion (10) on which the polygonal pin (16) is located;

(b) the wrench socket insert (3) is placed onto the polygonal pin (16);

(c) the retaining control member (2) is a removable screwdriver (2) having a cylindrical shaft, which is dimensioned to be adapted to the longitudinal throughbore (18), and having a profiled engagement portion (40);

characterized in that (d) the retaining control member constitutes a rotary tool element (2) adapted to be pulled out from the longitudinal throughbore (18), rotatable in the longitudinal throughbore (18), and defining a cylindrical peripheral surface which is engaged by an inner side of said detent ball (22) in order to thereby keep the detent ball (22) in engagement with the tool element (3);

(e) the transverse bore (20) defines an inner end provided with a constriction (24) engaged by the detent ball (22) in an innermost position thereof and preventing the detent ball (22) from falling out from the transverse bore (20) into the longitudinal throughbore (18) when the rotary tool element (2) is pulled out from the longitudinal throughbore; and (f) the detent ball (22), when assuming its innermost position, is forced out completely from the detent passage (28) and back into the transverse bore (20).

2. The rotary tool as defined in claim 1, characterized in that the transverse bore (20) has a conically tapered inner end defining a conical inner restriction merging into an annular surface which is engaged by the detent ball (22).

3. The rotary tool as defined in claim 1, characterized in that the transverse bore (20) defines a calked opening at the outer surface of the polygonal pin (16) in order to prevent the detent ball (22) from falling out from the transverse bore (20).

4. The rotary tool as defined in claim 1, characterized in that the screwdriver (2) is an angled screwdriver.

5. The rotary tool as defined in claim 1, characterized in that the wrench socket insert (3) placed onto the polygonal pin (16), constitutes an extension element (46) which, in turn, has an associated polygonal pin (16A) for receiving the wrench socket insert (3); the extension element (46) and the associated polygonal pin (16A) have a longitudinal throughbore (47) aligned with the longitudinal throughbore (18) extending through the tool element (3) and the polygonal pin (16); the polygonal pin (16A) associated with the extension element (46) contains a transverse bore (20A) opening, at one of its ends, into the longitudinal throughbore (47) and, at an other end, at the outer surface of the polygonal pin (16A); and respective detent balls are received in the transverse bores (20 20A) for respectively holding in locking manner the extension element (46) at the rotatable element (10) and the tool element (3) at the extension element (46).

* * * * *